US007449248B2

(12) United States Patent
Thuis et al.

(10) Patent No.: US 7,449,248 B2
(45) Date of Patent: Nov. 11, 2008

(54) SCREEN MATERIAL MANUFACTURING METHOD AND APPLICATIONS THEREOF

(75) Inventors: Henricus Hermanus Wilhelmus Thuis, Boxmeer (NL); Cornelis Johannes Jeckmans, Boxmeer (NL)

(73) Assignee: Stork Prints B.V., AT Boxmeer (NL)

( * ) Notice: Subject to any disclaimer, the term of this patent is extended or adjusted under 35 U.S.C. 154(b) by 383 days.

(21) Appl. No.: 10/534,552

(22) PCT Filed: Nov. 10, 2003

(86) PCT No.: PCT/NL03/00786

§ 371 (c)(1),
(2), (4) Date: Sep. 26, 2005

(87) PCT Pub. No.: WO2004/043659

PCT Pub. Date: May 27, 2004

(65) Prior Publication Data

US 2006/0141279 A1 Jun. 29, 2006

(30) Foreign Application Priority Data

Nov. 12, 2002 (NL) ..... 1021907
Mar. 24, 2003 (NL) ..... 1023005

(51) Int. Cl.
*C25D 1/08* (2006.01)

(52) U.S. Cl. ..... 428/596; 428/600; 205/75; 29/896.6; 29/896.62; 29/447

(58) Field of Classification Search ..... 205/75; 428/596, 597
See application file for complete search history.

(56) References Cited

U.S. PATENT DOCUMENTS 661,615 A * 11/1900 Marwick et al. ..... 428/597
1,934,643 A 11/1933 Rafton
2,004,747 A * 6/1935 Daly ..... 428/613
2,005,606 A * 6/1935 Wall ..... 131/237
2,158,929 A * 5/1939 Dunajeff ..... 428/596
2,166,366 A * 7/1939 Norris ..... 430/6
2,250,435 A * 7/1941 Norris ..... 204/281
2,439,283 A * 4/1948 Bennett ..... 99/450

(Continued)

FOREIGN PATENT DOCUMENTS

EP 0 038 104 A1 10/1981

(Continued)

*Primary Examiner*—John J Zimmerman
(74) *Attorney, Agent, or Firm*—Thomas, Kayden, Horstemeyer & Risley, LLP; Todd Deveau

(57) ABSTRACT

A metal screen material (32) having a flat side, in particular electroformed screen material, preferably seamless cylindrical screen material, comprises a network of dikes (34) which are connected to one another by intersections (36), which dikes (34) delimit openings (30). The height of the crossing points (36) is not equal to the height of the dikes (34). The metal screen material (32) or a combination thereof with a perforating screen (17) can he used as a perforating stencil for the perforation of film material (2), for example made from plastic material.

21 Claims, 3 Drawing Sheets

U.S. PATENT DOCUMENTS

| | | | | | |
|---|---|---|---|---|---|
| 2,743,541 | A | * | 5/1956 | Schultz | 38/66 |
| 2,871,556 | A | * | 2/1959 | Alpin | 29/513 |
| 2,969,586 | A | * | 1/1961 | Victor | 428/597 |
| 3,155,460 | A | * | 11/1964 | Mears | 428/596 |
| 3,759,799 | A | | 9/1973 | Reinke | |
| 4,168,348 | A | * | 9/1979 | Bhangu et al. | 428/573 |
| 4,226,686 | A | * | 10/1980 | Hustler | 205/660 |
| 4,303,747 | A | * | 12/1981 | Bender | 429/161 |
| 4,342,314 | A | | 8/1982 | Radel et al. | |
| 4,343,119 | A | * | 8/1982 | Bahnfleth | 52/180 |
| 4,401,520 | A | * | 8/1983 | Steppan et al. | 205/75 |
| 4,604,156 | A | | 8/1986 | Raley et al. | |
| 4,609,518 | A | | 9/1986 | Curro et al. | |
| 5,312,694 | A | * | 5/1994 | Sugawara | 428/592 |
| 5,359,928 | A | * | 11/1994 | Blessington et al. | 101/128.4 |
| 5,453,173 | A | | 9/1995 | Oyama | |
| 5,514,105 | A | | 5/1996 | Goodman, Jr. et al. | |
| 5,584,983 | A | | 12/1996 | Pruyn | |
| 5,676,501 | A | | 10/1997 | Peetz | |
| 5,681,301 | A | | 10/1997 | Yang et al. | |
| 5,939,172 | A | | 8/1999 | Snakenborg et al. | |
| 6,024,553 | A | | 2/2000 | Shimalla | |
| 6,305,432 | B1 | * | 10/2001 | Sacks et al. | 139/425 R |

FOREIGN PATENT DOCUMENTS

| | | | | |
|---|---|---|---|---|
| EP | 0 049 022 | A1 | | 4/1982 |
| EP | 0 492 731 | A1 | | 7/1992 |
| EP | 0705933 | | | 4/1996 |
| EP | 0 862 904 | A2 | | 9/1998 |
| JP | 59-175237 | | * | 10/1983 |
| WO | WO 97/40213 | | | 10/1997 |
| WO | WO 99/20813 | | | 4/1999 |

* cited by examiner

SCREEN MATERIAL MANUFACTURING METHOD AND APPLICATIONS THEREOF

CROSS REFERENCE TO RELATED APPLICATION

This application claims priority to and the benefit of Netherlands Application No. 1021907 filed 12 Nov. 2002 and Netherlands Application No. 1023005 filed 24 Mar. 2003.

BACKGROUND OF THE ART

According to a first aspect, the invention relates to a screen material made from metal having a flat side, comprising a network of dykes which are connected to one another by crossing points, which dykes delimit openings. More particularly, the invention according to this aspect relates to electroformed screen material, preferably seamless cylindrical screen material.

FIELD OF THE INVENTION

Screen material of this type is known in the specialist field and is used for numerous purposes, such as screen-printing, perforating plastic films, etc. A perforating method and device are known, for example, from U.S. Pat. No. 6,024,553.

In this known method for manufacturing perforated plastic films, a thin plastic film is guided over a perforated cylinder, also known as a perforating stencil, and the film is locally exposed to a pressurized fluid, such as water or air. As a result, the film is locally deformed into the perforations of the perforated cylinder and is pressed into them until, the film breaks, so that perforations are formed in the film at these locations.

The perforating stencil used in this known method comprises a moulding cylinder having an external moulding surface and an internal securing surface, and a support cylinder, which bears the moulding cylinder. A support structure of this type is often required in order to lengthen the service life of the stencil, which is adversely affected by the pressurized fluid, such as water. Discharge holes for discharging the fluid extend through the wall of the moulding cylinder. If the support cylinder covers certain discharge holes, there is a risk of no perforations or insufficient perforations being formed in the film at these locations. Also, the shape of a perforation which is formed may be adversely affected by fluid which splashes up or flows back. To avoid these risks, according to the above patent it is proposed to incorporate a fluid-permeable structure, such as a metal screen or mesh, between the moulding cylinder and the support cylinder, the transverse dimensions (width) of the dykes or wires of the fluid-permeable structure being smaller than the largest diameter of the generally circular or oval discharge holes. All the discharge holes are therefore at least partially open, and (partial) blockage of the discharge holes is avoided. The fluid can be successfully drained away and discharged.

In general, it can be stated that a perforating stencil on the one hand has to have a sufficient strength and on the other hand good discharge of fluid has to be ensured.

The manufacture of a perforating stencil with a layered structure, in accordance with the above U.S. patent, is complicated, however, on account of the need to align the openings in the various layers. This is because unaligned openings could give rise to what is known as the Moiré effect, on account of the presence of regular patterns of openings which partially overlap one another. This Moiré effect can give rise to an absence of perforations or an insufficient number of perforations in the plastic film.

SUMMARY OF THE INVENTION

On account of the abovementioned complexity of the known perforating stencil, there is a need for alternatives which on the one hand are sufficiently strong and on the other hand offer a good quality of perforation. It is an object of the invention to satisfy this requirement.

Furthermore, the present invention is based on the object of providing a screen material, in particular for use in the perforation of plastic films, in which the risk of the Moiré effect occurring is reduced.

To this end, the invention provides a metal screen material having a flat side, comprising a network of dykes which are connected to one another by crossing points, which dykes delimit openings, the thickness of the crossing points not being equal to the thickness of the dykes.

An important technical aspect of the screen material according to the invention is that the screen material, which has a flat side, does not have a uniform thickness (height), but rather the thickness of the crossing points, i.e. connecting points, of the separate dykes differs from that of the dykes themselves. When the screen material according to the invention is used as a support structure in a perforating stencil, this on the one hand provides a large number of support points for the perforating screen or moulding cylinder. On the other hand, this structure ensures that the perforating stencil has a good permeability, since there is sufficient permeability in the plane of the supporting structure between the dykes and crossing points. The differing height of the crossing points with respect to the dykes is only present on one side in the screen material according to the invention, specifically on the opposite side from the flat side. In this description, the term screen material is understood as meaning a thin material, the main surfaces of which are referred to as sides, to distinguish them from the thin side edges. The term "flat" means planar, without projecting parts. The screen material may, for example, be in plate form, but is preferably a seamless cylinder.

It should be noted that screen material based on a woven structure is known per se, and in this material if desired the threads of the woven structure are bound to one another by the application of an electroformed coating layer. However, a screen material of this type does not have any flat sides, since the threads of the woven structure cross one another on each side alternately. As a result of these thread crossings, the thickness of a screen material of this type is greater at the location of these crossing points than the thickness of the separate threads. Examples of screen materials of this type based on a woven structure are described, inter alia, in U.S. Pat. Nos. 1,934,643, 5,939,172, 5,453,173, 3,759,799, 4,609,518 and the abovementioned document U.S. Pat. No. 6,024,553.

In the invention, the screen material is advantageously made from a single piece, as will become apparent below from the description of a method used to manufacture it.

According to a preferred embodiment of the screen material according to the invention, the thickness of the crossing points is greater than the thickness of the dykes, as will be explained in more detail below. The difference between the thickness of the crossing points and the thickness of the dykes is preferably in the range from 20-250 micrometres, more preferably in the range from 100-200 micrometres.

With regard to the contact surface with a perforating screen above, the apex angle of an elevated crossing point is advantageously less than 120°, for example 100° in the case of a height difference of 130 micrometres.

The screen material is advantageously tubular, and more particularly the screen material is in the form of a seamless cylinder, so that the entire circumferential surface may be provided with screen openings, optionally in a regular pattern. The screen material, in particular in cylinder form, is preferably obtained electrolytically, as will be explained below.

The preferably electroformed screen material according to the invention, for use as a support screen in an assembly of support screen and perforating screen, which assembly is suitable for use for the perforation of thin films, advantageously has one or more of the following properties:

A mesh number of 30-80 mesh. By way of example, the openings are arranged in a hexagonal, orthogonal or other regular pattern. With a mesh number of less than 30, there is a risk of the support screen not supporting the perforating screen to a sufficient extent, while with a fineness of more than 80 mesh there is a risk of process water used to form perforations in the film by means of water jets being insufficiently drained away.

With a view to strength, the overall thickness of the screen material (including elevated sections) is advantageously greater than 600 micrometres (typically 900-1000 micrometres). The permeability of the screen material (optical openness) is advantageously more than 25% (typically 40%-50%).

The metal used for the screen material according to the invention is preferably nickel.

According to a second aspect, the invention relates to a method for producing metal screen material having a flat side, comprising a network of dykes which are connected to one another by crossing points and which dykes delimit openings, in particular screen material according to the invention. The method according to the invention comprises at least one or more growth steps for electrolytically thickening a screen skeleton with flat sides in an electroplating bath under controlled conditions, in such a manner that in at least one growth step the growth rate of the crossing points is not equal to the growth rate of the dykes, so that in the screen material the thickness of the crossing points is not equal to the thickness of the dykes.

In this method according to the invention, the starting material used is a screen skeleton with two flat sides. A skeleton of this type is a very thin screen material which defines the basic two-dimensional shape of the network. A skeleton of this type can be obtained in a manner known per se, preferably by electroforming on an electrically conductive die which is provided with separate insulator islands, for example made from photoresist, which correspond to the screen openings which are to be formed. The dykes correspond to the die tracks or parts which are not covered with insulating material. According to the invention, this skeleton is subjected to one or more growth steps under controlled process conditions. Generally, an incipient height difference between dykes and crossing points is produced in a first step, and this height difference is then enhanced in subsequent steps.

In other words, the screen material is advantageously produced with the aid of a multistage electroforming process. This process comprises:

Phase 1. The deposition of a metal screen skeleton with flat sides, for example made from nickel, on a die, preferably a cylindrical die.

Phase 2. This phase comprises one or more thickening steps or growth steps. The conditions of the thickening steps are selected in such a way that the desired dyke shape and crossing point shape are formed, it being possible for the height differences between the dykes and the crossing points to be either positive or negative, depending on what is desired or required for the intended application. The growth may take place on both sides, in which case, however, the differing growth rate with regard to the location of dykes and crossing points only occurs on one side. The thickening steps have a selective growth character, which manifests itself in electrolytic growth which preferably does not take place in the holes but does take place on the dykes and crossing points, i.e. there is scarcely any widening of the dykes or crossing points compared to the amount of growth in the thickness direction.

In one of the thickening steps, the dyke shape and the height difference of a basic shape of the screen material ultimately obtained are defined. During the subsequent step or steps, this basic shape can be grown further until the desired final thickness is reached, and the shape aspects are made more pronounced or enhanced.

The height differences which are formed in the thickening step which provides the basic shape are advantageously controlled by one or more of the following parameters.

Forced flow of the bath liquid through the screen skeleton. The flow rate of the electrolyte is advantageously in the range from 200-600 l/dm$^2$ per hour, and is typically 300 l/dm$^2$/hour. If the flow rate of the electrolyte through the screen material is higher, uncontrolled turbulence occurs, with the result that the locations on the screen skeleton which are exposed to most electrolyte agitation will grow the least. If the flow rate is low, there will be scarcely any selective growth.

Concentration of brightener. The concentration is advantageously in the range from 200-500 g/l (typically 400 g/l). An excessively high concentration of the brightener generally results in a brittle deposit. Lowering the brightener content reduces the selective growth character. It is preferable to use a brightener with properties belonging to the first and second classes. Examples of brighteners of this type are described in European Patent Application 0 492 731.

A current density of between 5 and 40 A/dm$^2$ (typically approximately 15 A/dm$^2$).

Another factor which influences the local growth is what is known as the primary current distribution, which is related to the geometric distribution of the metal which is already present. Given an identical distance between anode and cathode (skeleton), narrow shapes grow to a greater extent than wider shapes.

The invention also relates to the use of the screen material according to the invention or the screen material obtained using the method according to the invention for the perforation of film material. The screen material according to the invention is advantageously used as a support screen, but can also be used as a perforating screen.

Furthermore, the invention relates to an assembly of a support screen and a perforating screen, in which the support screen comprises screen material according to the invention or screen material obtained using the method according to the invention. This assembly of concentric screens is also known as a perforating stencil. It is preferable for the mesh number of the support screen to be lower than that of the perforating screen.

When two screens with more or less regular patterns of openings are placed on top of one another, a Moiré effect generally occurs as a result of interference. This effect may be disruptive in the perforated product, since perforations which it is intended to produce will not be formed or will not completely be formed. With the combination of screens according to the invention, this phenomenon is suppressed by the small contact area between the elevated crossing points of the support screen and the perforating screen. The ratio of the mesh numbers of the two screens also plays a role. It has been found that the Moiré effect for two regular patterns is least disruptive if the ratio between two repeat frequencies of the two patterns is an integer number ±0.5 (1.5, 2.5; 3.5, etc.).

This means that in the case of a perforating screen of 100 mesh, the support screen preferably has one of the following mesh numbers: 66.6 mesh; 40 mesh; 28.6 mesh; 22.2 mesh, etc. The extent to which this Moiré formation is minimized (i.e. no longer perceptible) increases for coarser support screens. It has been found that the disruptive Moiré effect is no longer perceptible when a sheet is perforated using a 100 mesh perforating screen and a 40 mesh support screen in accordance with the invention.

The invention also relates to various methods for manufacturing an assembly of a tubular perforating screen and a tubular support screen.

A first method for manufacturing an assembly of a support screen and a perforating screen, in particular cylindrical (seamless) screens, comprises at least one step of shrinking the perforating screen onto the support screen.

During the electrolytic growth of screen material, internal stress is built up, as a function, inter alia, of the current intensity, the type of brightener which is added, the concentration of this brightener, the process temperature and the flow rate through the screen material in the direction of the anode. Subjecting the screen material to a heat treatment, for example in the case of nickel at a temperature of 120-220° C. for approx. 1 hour, generally causes shrinkage of the screen material of the order of 0.1%. In the method according to the invention, the shrinkage characteristics of the two screens are used to secure the screens taut to one another. In this case, it is advantageous for a cylindrical support screen to be subjected to a heat treatment at elevated temperature, so that a support screen with a defined outer diameter (OD) is obtained, and for a cylindrical perforating screen with an inner diameter (ID) which is slightly larger than the outer diameter (OD) of the support screen to be arranged over the support screen, and for the unit comprising support screen and perforating screen to be subjected to a heat treatment at a temperature which is lower than the temperature of the heat treatment of the support screen, for a sufficient time to shrink the perforating screen onto the support screen.

The method according to the invention produces a cylindrical support screen with a defined diameter, for example a diameter in the range from 200-1000 micrometres, advantageously greater than 600 micrometres. The process conditions, as indicated above, are selected in such a way that the stress which is incorporated will result in a shrinkage of 0.1%. The screen obtained in this way is subjected to a heat treatment, with the result that the diameter of the cylinder is reduced through shrinkage. The result is a cylindrical screen material with a defined outer diameter (OD). A second (outer) screen as perforating screen is produced with an inner diameter (ID) which is 0.1% larger than the OD of the support screen. The two screens are slid over one another and the assembly is subjected to a heat treatment at a temperature which is lower than the temperature of the heat treatment of the support screen. During this process step, the outermost screen will shrink in such a manner that it comes to bear taut around the base or support screen. On account of its rigidity, the screen combination obtained in this way has a longer service life than the outermost perforating screen alone.

Incidentally, it should be noted at this point that it is described in U.S. Pat. No. 6,024,553 that the controlled shrinkage of the starting sleeve for the moulding cylinder can be used to define its desired diameter with regard to the thickness of the porous structure.

Another method for manufacturing an assembly of a tubular support screen and a tubular perforating screen, in particular cylindrical seamless screens, according to the invention comprises at least one step of arranging a deformed support screen in the perforating screen and restoring the original shape of the support screen. In a preferred embodiment of this method, to restore the original shape of the support screen an inflatable container is placed into the support screen and is then pressurized. In this method, the ID of the outer screen is in principle selected to be equal to the OD of the inner screen. As a result of the inner screen being pressed into a kidney shape and the inner screen being positioned in the outer screen in this shape and then being returned to its original round shape with the aid of an inflatable container, such as an airbag, a good fit between the screens is obtained. In this case, the inner diameter of the perforating screen may advantageously be slightly smaller than the outer diameter of the support screen, so that an even tighter fit is obtained. The outer screen is then under tensile stress.

Yet another method for manufacturing an assembly of a support screen and a perforating screen, in particular cylindrical seamless screens, comprises at least one step of pushing the perforating screen over the support screen with the aid of a pressurized fluid. This method for positioning two screens taut around one another involves filling both the holes in the inner screen and the holes in the outer screen with a non-permanent agent, for example photoresist. By creating an air cushion between the innermost screen and the outermost screen comprising a pressurized fluid, such as compressed air, with the aid of a push-on flange, it is possible for the outermost screen to be stretched in such a manner that it can easily be slid over the inner screen. When the pressure is reduced, the outermost screen shrinks around the inner screen. If the inner screen is not sufficiently stable and dimensionally rigid to withstand the compressed air, a sufficiently strong auxiliary cylinder can be introduced into the inner screen during this process step. After the screens have been pushed over one another, the resist is removed.

BRIEF DESCRIPTION 0F THE DRAWINGS

The invention is explained below with reference to the appended drawing, in which.

DETAILED DESCRIPTION

EXAMPLE

A 40 mesh hexagonal screen was produced in the following way. The base was formed by a cylindrical Ni skeleton with flat inner and outer sides which was deposited on a die from an electrolytic bath. The thickness of the skeleton of 57 micrometres and a permeability of 53% are achieved at a current density of 30 A/dm$^2$. A first thickening step took place with a flow rate through the skeleton of 240 l/dm$^2$ per hour from the inside outwards, a current density of 10 A/dm$^2$ with a brightener concentration of 380 g/l. The brightener used was 1-(3-sulphopropyl)quinoline. The resulting basic shape had a thickness of 270 micrometres, a permeability of 50% and a height difference between the crossing points and the dykes of approximately 30 micrometres. The second thickening step took place with a brightener concentration of 420 g/l, a flow rate of 300 l/dm$^2$ per hour and a current density of 15 A/dm$^2$. The resulting screen material had a thickness of 900 micrometres, a permeability of 45% and a height difference between crossing points and dykes of 130 micrometres. The apex angle of the crossing points was 90-110°. The height differences were present on the outer side, while the inner side had remained flat.

Figure 1:
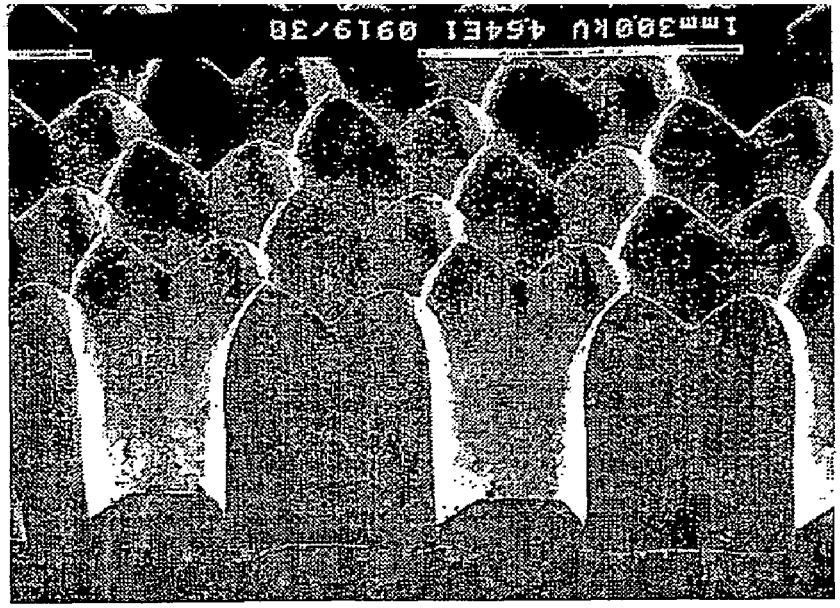
FIGS. 1 and 2 are photographs of a screen material according to the invention.
Figure 2:
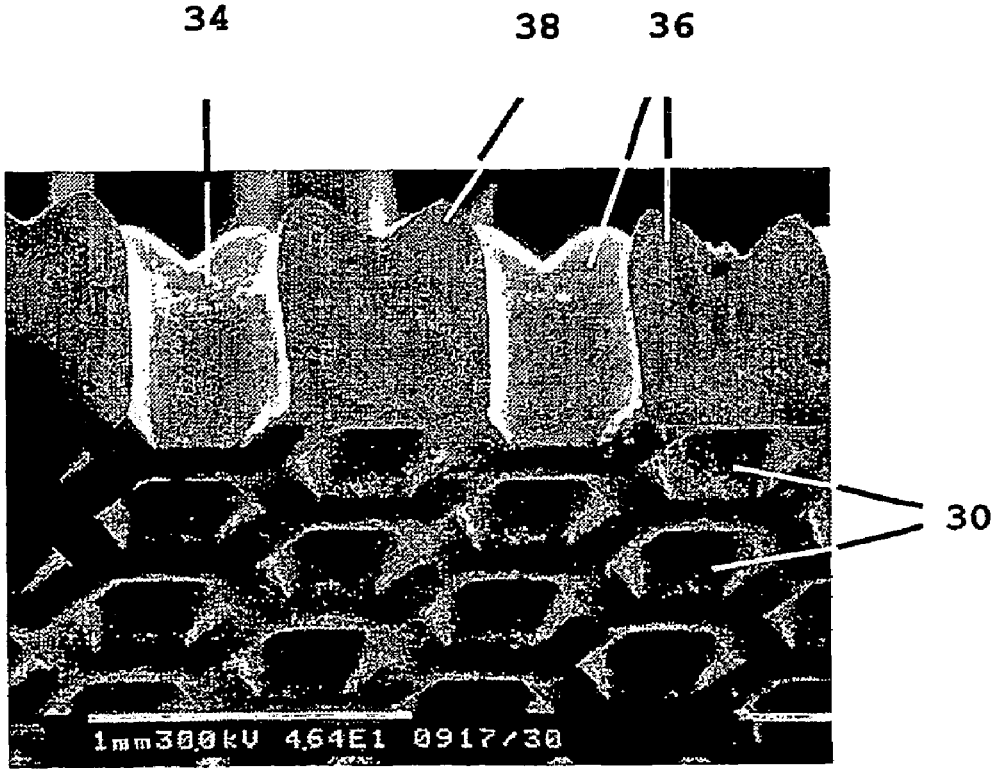

FIGS. 1 and 2 show photographs of the resulting screen material, in which the dykes are denoted by reference numeral 34, the openings by 30, the crossing points by 36 and the apex angle thereof by 38.

Figure 3:
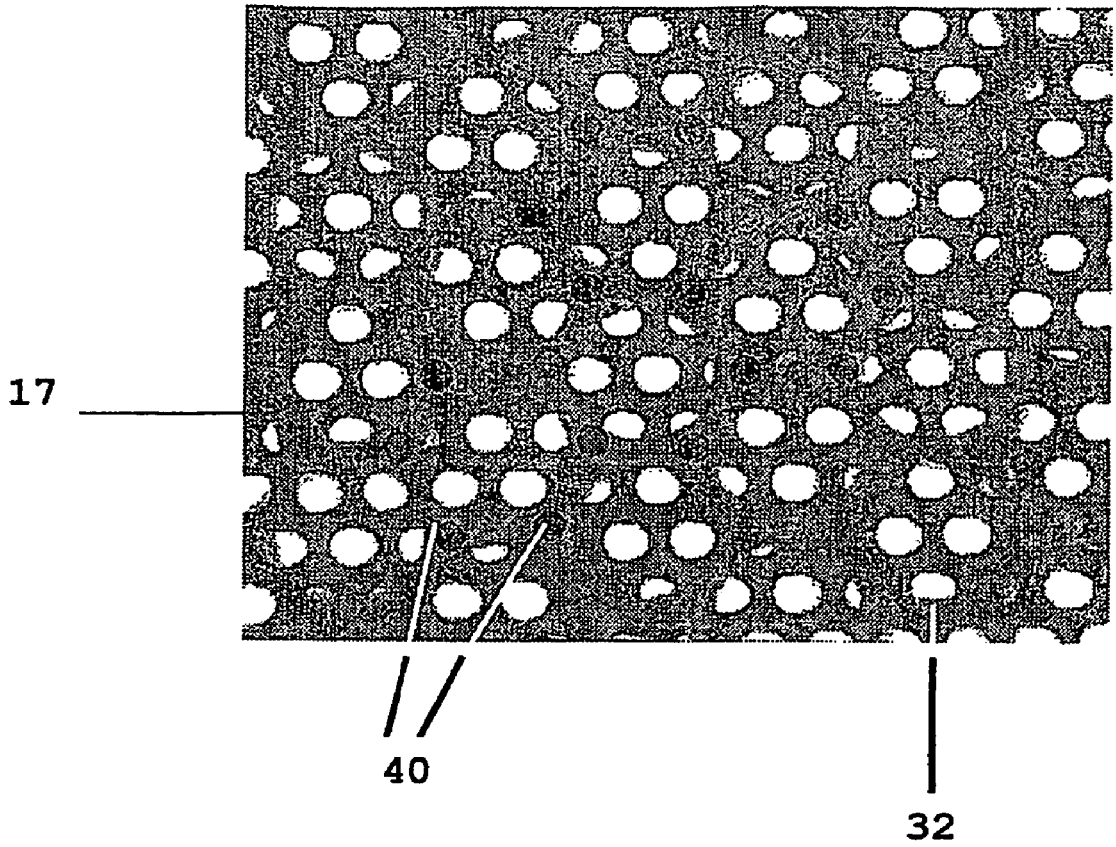
FIG. 3 is a photograph of an assembly of a support screen and perforating screen according to the invention.

The screen material is preferably used as a support screen for a screen with a higher mesh number, for example with a mesh number of 100 mesh. For some applications, such as film perforation, it is desirable to use a screen with a mesh number of typically between 60 and 150 mesh. These types of screen are characterized by a limited stability with regard to the high forces which are applied to the screen material during the film-perforating process, for example vacuum perforation at elevated temperatures at which the film is deformable, or water-jet perforation at lower temperatures. Therefore, the open surface area of the support screen has to be larger than that of the perforating screen (outer screen). The elevations and the small apex angle (<120°) of the crossing points prevent excessive numbers of holes in the perforating screen being completely or partially blocked, which would result in the sheet not being perforated at the positions of these holes. Cf. FIG. 3, which shows a photograph of an assembly of a support screen 32 and a perforating screen 17. The perforating screen 17 is supported on the support screen 32 at the positions 40 indicated by dark round dots.

Figure 4:
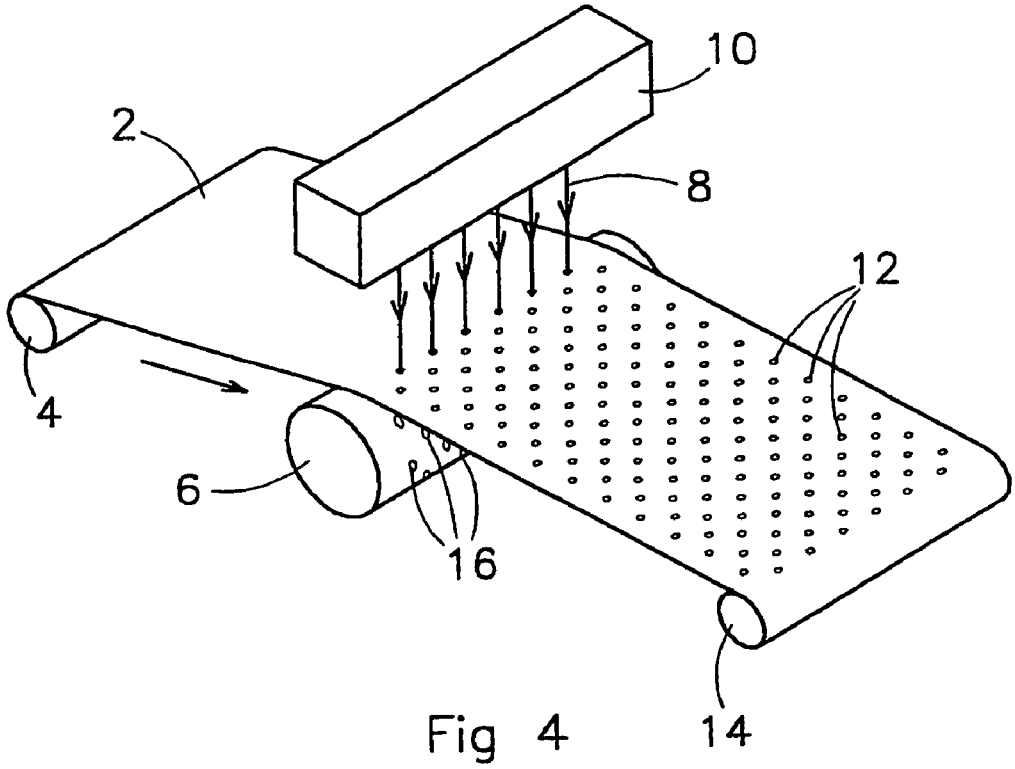
FIG. 4 shows a diagrammatic representation of the perforation of a plastic film.

FIG. 4 illustrates the perforation of a plastic film using a perforating stencil. In FIG. 4, a thin plastic film 2, for example made from polyethylene, is unwound from a stock reel 4 and guided over a perforating stencil 6, where the film is perforated by water jets 8 with a pressure of, for example, 4 bar, from a water jet device 10. After perforation, the film 2, which has been provided with perforations 12, is wound up again onto a reel 14. The perforating stencil 6 is provided with a pattern of continuous openings 16.

Figure 5:
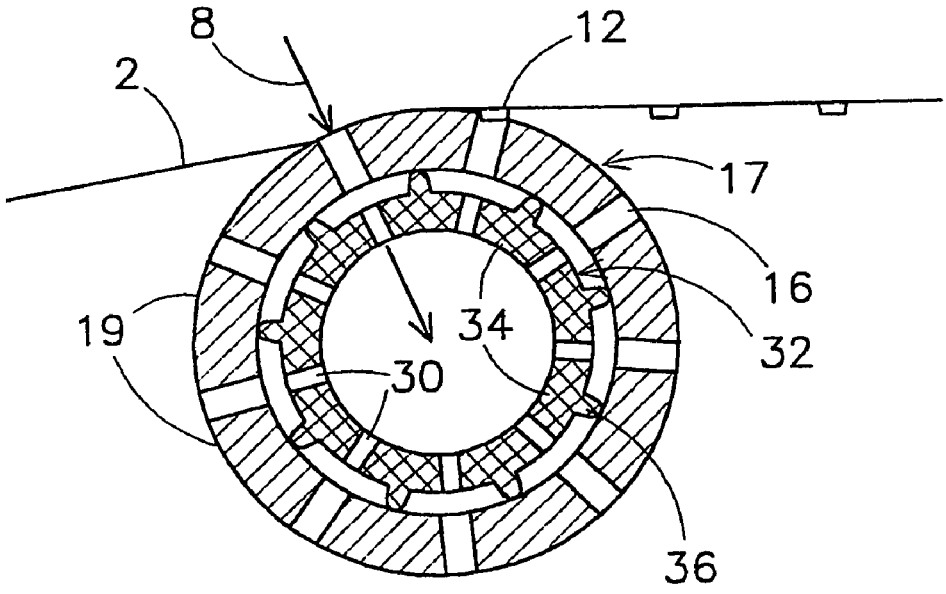
FIG. 5 shows a diagrammatic cross section through an embodiment of an assembly according to the invention.

FIG. 5 illustrates a cross section through an embodiment of a perforating stencil during operation. Identical components are denoted by identical reference numerals. The stencil 6 comprises an electroformed nickel moulding cylinder 17 as perforating screen having a diameter of, for example, approximately 30 cm and a wall thickness of 600 micrometres, in which there are round openings 16 (mesh number 100) which are delimited by dykes 19. On the inside of the cylinder 17 there is a support screen 32 provided with openings 30. The openings 30 are delimited by dykes 34 of the support screen 32. The crossing points 36, which connect dykes 34 to one another, have a greater thickness than these dykes 34 themselves. At the location of an opening 16, the film is deformed under the pressure of a water jet 8 and is pressed into the opening until the film 2 breaks. This results in the formation of a perforation 12 having the form indicated, which is favourable for numerous absorbent applications, and since the water is easily discharged via the support screen, this form of perforation is retained. The water which penetrates through is drained away in a suitable way at the inner circumference of the support screen.

Examples of applications for perforated film include, inter alia, agricultural plastic, absorbent articles, including absorbent products for personal care, for example diapers and sanitary towels. Applications of this nature make use of the (direction-dependent) permeability of the perforated film.

What is claimed is:

1. Metal screen material having a flat side without projecting parts, comprising a network of dikes which are connected to one another by intersections, which dikes delimit openings, the height of the intersections not being equal to the height of the dikes only on the side of the screen material opposite to the flat side, wherein the height of the intersections is greater than the height of the dikes, wherein the difference between the height of the intersections and the height of the dikes is in the range from 20-250 micrometers, and wherein the screen material is electroformed.

2. Screen material according to claim 1, wherein the difference is in the range from 100-200 micrometers.

3. Screen material according to claim 1, wherein the intersections have an apex angle of less than 120°.

4. Screen material according to claim 1, wherein the screen material is in the form of a seamless cylinder.

5. Assembly of a support screen and a perforating screen, in which the support screen comprises screen material according to claim 1.

6. Method for perforating film material, wherein the film material is perforated using an assembly of a support screen and a perforating screen, in which the support screen comprises screen material according to claim 1.

7. Method for manufacturing metal screen material having a flat side without projecting parts, comprising a network of dikes which are connected to one another by intersections, which dikes delimit openings, comprising at least one or more growth steps for electrolytically thickening a flat screen skeleton in an electroplating bath under controlled conditions, in such a manner that in at least one growth step the growth rate of the intersections is not equal to the growth rate of the dikes, so that in the screen material the height of the intersections is greater than the height of the dikes only on the side of the screen material opposite to the flat side.

8. Method according to claim 7, wherein the controlled conditions comprise a forced flow of the bath liquid through the screen skeleton.

9. Method according to claim 8, wherein the flow rate of the bath liquid is in the range from 200 l/dm$^2$ to 600 l/dm$^2$.

10. Method according to claim 7, wherein the bath liquid comprises a brightener in a concentration in the range from 200-500 g/l.

11. Method according to claim 10, wherein the bath liquid comprises a brightener having properties of the first and second classes.

12. Method according to claim 7, wherein the current density is in the range from 5 to 40 A/dm$^2$.

13. Assembly of a support screen and a perforating screen in which the support screen comprises screen material obtained using the method according to claim 7.

14. Method for manufacturing an assembly of a tubular support screen and a tubular perforating screen, in particular cylindrical seamless screens, at least comprising a step of shrinking the perforating screen onto the support screen, wherein the support screen comprises screen material having a flat side without projecting parts, comprising a network of dikes which are connected to one another by intersections, which dikes delimit openings, the height of the intersections being greater than the height of the dikes only on the side of the screen material opposite to the flat side.

15. Method according to claim 14, wherein a cylindrical support screen is subjected to a heat treatment at elevated temperature, so that a support screen with a defined outer diameter (OD) is obtained, and in that a cylindrical perforating screen with an inner diameter (ID) which is slightly greater than the outer diameter (OD) of the support screen is fitted over the support screen, and the unit comprising support screen and perforating screen is subjected to a heat treatment at a temperature which is lower than the temperature used for the heat treatment of the support screen, for a sufficient time to shrink the perforating screen onto the support screen.

16. Method for manufacturing an assembly of a tubular support screen and a tubular perforating screen, in particular cylindrical seamless screens, at least comprising a step of arranging a deformed support screen in the perforating screen and restoring the original shape of the support screen, wherein the support screen comprises screen material having a flat side without projecting parts, comprising a network of dikes which are connected to one another by intersections, which dikes delimit openings, the height of the intersections being greater than the height of the dikes only on the side of the screen material opposite to the flat side.

17. Method according to claim 16, wherein to restore the original shape of the support screen, an inflatable container is placed into the support screen and is then pressurized.

18. Method according to claim 16, wherein the inner diameter of the perforating screen is slightly smaller than the outer diameter of the support screen.

19. Method according to claim 16, at least comprising a step of arranging a deformed support screen in the perforating screen and restoring the original shape of the support screen, wherein a support screen obtained using the method according to claim 8 is used, which comprises at least one or more growth steps for electrolytically thickening a flat screen skeleton in an electroplating bath under controlled conditions, in such a manner that in at least one growth step the growth rate of the intersections is not equal to the growth rate of the dikes, so that in the screen material the height of the intersections is greater than the height of the dikes only on the side of the screen material opposite to the flat side.

20. Method for manufacturing an assembly of a tubular support screen and a tubular perforating screen, in particular cylindrical seamless screens, at least comprising a step of pushing the perforating screen over the support screen with the aid of a pressurized fluid, wherein the support screen comprises screen material having a flat side without projecting parts, comprising a network of dikes which are connected to one another by intersections, which dikes delimit openings, the height of the intersections being greater than the height of the dikes only on the side of the screen material opposite to the flat side.

21. Method according to claim 20, at least comprising a step of pushing the perforating screen over the support screen with the aid of a pressurized fluid, wherein a support screen obtained using the method according to claim 8 is used, which comprises at least one or more growth steps for electrolytically thickening a flat screen skeleton in an electroplating bath under controlled conditions, in such a manner that in at least one growth step the growth rate of the intersections is not equal to the growth rate of the dikes, so that in the screen material the height of the intersections is greater than the height of the dikes only on the side of the screen material opposite to the flat side.

* * * * *